United States Patent [19]

Solloway

[11] Patent Number: 4,521,011

[45] Date of Patent: Jun. 4, 1985

[54] HAND ENGAGEABLE AQUATIC EXERCISE ASSEMBLY

[76] Inventor: Daniel S. Solloway, 1315 18th St., Woodward, Okla. 73801

[21] Appl. No.: 429,270

[22] Filed: Sep. 30, 1982

Related U.S. Application Data

[63] Continuation-in-part of Ser. No. 314,690, Oct. 26, 1981, Pat. No. 4,411,422, which is a continuation-in-part of Ser. No. 79,966, Sep. 28, 1979, Pat. No. 4,311,306.

[51] Int. Cl.[3] ..... A63B 21/00

[52] U.S. Cl. ..... 272/116; 272/71; 441/59

[58] Field of Search ..... 272/116, 68, 67, 71, 272/130, 93; 441/56, 57, 58, 59; 273/67 B

[56] References Cited

U.S. PATENT DOCUMENTS

| | | | |
|---|---|---|---|
| 2,006,915 | 7/1935 | Ferber | 441/56 |
| 2,159,972 | 5/1939 | Larson | 441/58 |
| 2,692,995 | 11/1954 | Bihan | 441/57 |
| 2,771,618 | 11/1956 | Crum | 441/59 |
| 3,111,694 | 11/1963 | Nelson | 441/56 |
| 3,286,287 | 11/1966 | Martin | 441/57 |
| 3,408,670 | 11/1968 | Wolfe | 441/56 |
| 3,789,447 | 2/1974 | Lavallee | 441/59 |

FOREIGN PATENT DOCUMENTS

| | | | |
|---|---|---|---|
| 532944 | 9/1931 | Fed. Rep. of Germany | 441/56 |
| 273669 | 7/1927 | United Kingdom | 441/56 |
| 640355 | 7/1950 | United Kingdom | 441/58 |

*Primary Examiner*—Richard C. Pinkham
*Assistant Examiner*—Matthew L. Schneider
*Attorney, Agent, or Firm*—Thomas W. Tolpin

[57] ABSTRACT

A hydrodynamic stroke builder has a specially configured aquatic hand section and forearm section with fins to progressively strengthen a person's arms, shoulders, chest and back. The hydrodynamic stroke builder can be interchangeably used by men, women and children alike and permits a wide range of movement with controlled amounts of fluid resistive forces, torque and torsion underwater. The stroke building consists of a hand engaging section which is either flat or convex and which has holes therein so that the user's fingers can readily grasp the hand engaging section. The forearm section conforms to the shape of the user's forearm and has V or U shaped fins extending therefrom to provide the proper resistance when the device is being used. The stroke builder can also include an upper arm section similar in design to the forearm section. The various sections are connected together by way of hinges.

15 Claims, 26 Drawing Figures

100
102
104
106
106
108

110
112
114
116
118

120
122
124

123
126b
126a
130
132
134
136
138
140

142
144
146
148
149
150
151
152
154

160
162
164
164a
166
170
172
174

HAND ENGAGEABLE AQUATIC EXERCISE ASSEMBLY

CROSS REFERENCES TO RELATED APPLICATIONS

This application is a continuation-in-part of U.S. patent application Ser. No. 314,690, filed Oct. 26, 1981, now U.S. Pat. No. 4,411,422, issued Oct. 25, 1983, for an Aquatic Exercise Assembly, which is a continuation-in-part of U.S. patent application Ser. No. 79,966, filed Sept. 28, 1979, now U.S. Pat. No. 4,311,306, issued Jan. 19, 1982, for an Aquatic Exercise Assembly.

BACKGROUND OF THE INVENTION

This invention relates to an exercise assembly, and more particularly, to an exercise assembly for use in water.

Over the years, a variety of weight lifting and exercise devices such as barbells, have been developed. Typifying these weight lifting and exercise devices and other devices are those shown in U.S. Pat. Nos. 373,692; 654,097; 660,962; 717,041; 1,366,200; 1,676,689; 2,143,337; 3,260,523; 3,427,022; 3,671,988; 3,889,306; 4,029,312; 4,227,273; U.S. Pat. Nos. Des. 1,906,045 and 495,769; German Pat. No. 351,627; and Italian Pat. No. 615,402. These weight lifting and exercise devices have met with varying degrees of success.

Many of the conventional weight lifting and exercise devices, however, are relatively awkward, cumbersome, and complex, and are not suitable for interchangeable use by men, women and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional exercise devices exert an excess amount of torque and torsion (twist) on the joints of the user and are, therefore, not usually suitable for many types of physical therapy.

It is therefore desirable to provide an exercise assembly which overcomes most, if not all, of the above disadvantages.

SUMMARY OF THE INVENTION

A hydrodynamic stroke builder is provided for use underwater to improve muscle tone, enhance muscular coordination and strengthen the user's wrists, forearms, biceps, triceps, shoulders, back, chest, and stomach. Advantageously, the hydrodynamic stroke builder is readily useable by men, women and children alike, having different strengths and physical capabilities without the necessity of adding weights or making substantial structural modifications.

The hydrodynamic stroke builder is particularly useful for swimmers, boxers, quarterbacks, pitchers, basketball players, tennis players and other athletes, as well as for physical therapy in water, because the hydrodynamic torque, torsion and resitive forces which it exerts on the wrists, arms, shoulders, back chest, and stomach of the athlete or patient, can be readily controlled by the athlete or physical therapist by simply varying the acceleration, momentum or rate of movement of the stroke builder in the water to the desired amount. Desirably, the hydrodynamic stroke builder is easy to use, effective and relatively simple in design and construction for economy of manufacture.

To this end, the novel hydrodynamic stroke builder has a manually grippable hand section which is hingeably connected to an elongated forearm section. The hand section has a water impingement surface (forehand) and a palm-engaging portion (backhand) with finger holes. The finger holes can extend partly or entirely through the hand section or can be defined by rigid or flexible hoops that are bonded, laced or otherwise secured to the hand section. Preferably, the hand section has a plurality of sets of different size finger holes to accommodate different size hands. In lieu of finger holes, the hand section can have a wrist strap for attachment to the wrist or back of the hand, a single loop or C-ring for receiving a plurality of fingers or a handle. In one embodiment, the hand section is web-shaped with a flat palm-engaging portion and a flat water impingement surface. In another embodiment, the hand section has a concave palm-engaging portion (backhand) and a convex or bowl-shaped water impingement surface (forehand) which exerts substantially more fluid resistive forces on the user's arms when moved underwater towards the user's feet than when the backhand is moved away from the user's feet.

The forearm section has a forearm-engaging portion and at least one fin. Desirably, the forearm section has at least one strap to detachably secure the forearm-engaging portion to the user's forearm and has a pair of generally U-shaped or V-shaped fins which provide aquatic pockets that exert substantially more hydrodynamic fluid resistive forces on the user's arms when moved underwater towards the user's feet than when moved away from the user's feet.

Other types of aquatic exercise assemblies are also disclosed.

A more detailed explanation of the invention is provided in the following description and appended claims taken in conjuntion with the accompanying drawings.

DETAILED DESCRIPTION OF THE PREFERRED EMBODIMENTS

Figure 1:
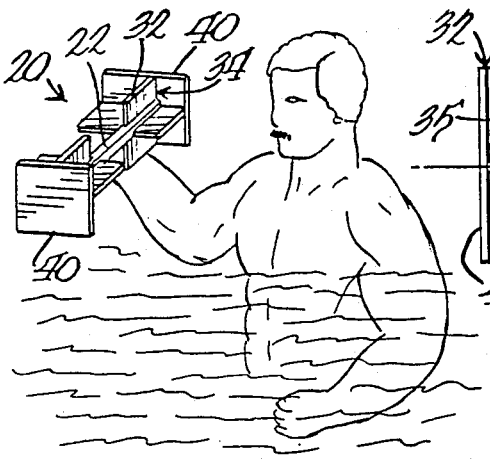
FIG. 1 is a perspective view of a barbell-like blade (fin) type of aquatic exercise assembly being lowered into the water by a weight lifter in accordance with principles of the present invention.
Figure 2:
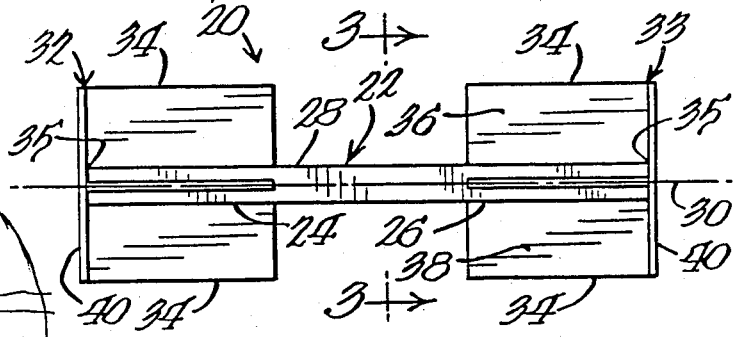
FIG. 2 is an enlarged front view of the aquatic exercise assembly of FIG. 1.
Figure 3:
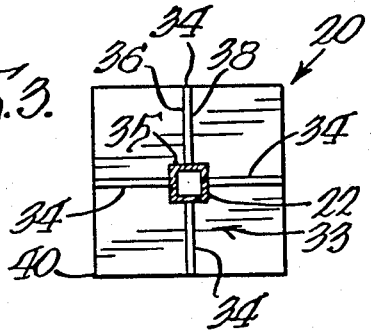
FIG. 3 is a cross-sectional view of the aquatic exercise assembly of FIG. 1 taken substantially along line 3—3 of FIG. 2.

Referring now to FIGS. 1–3 of the drawings, a barbell-like blade or fin type of aquatic exercise assembly 20, sometimes referred to as an aquatic exerciser, is shown for use in water by weight lifters, patients, paraplegics and other persons desirous of strengthening their muscles, improving their muscle tone, and enhancing their muscular coordination. Exercise assembly 20 is helpful to improve the cardiovascular system and general physical well being and strength of the user.

Exercise assembly 20 is particularly useful to physical therapists because it permits a greater range of motion in the water than conventional barbells and many other types of conventional weight lifting and exercise devices that are used on land, such as in gymnasiums, and because it permits the physical therapist to control the magnitude of the forces, torque and torsion exerted by the assembly on the patient, while minimizing harsh impact forces and shock on the patient's joints. Such control can be exercised by selectively varying the acceleration or momentum of the of the exercise assembly to the desired amount. Advantageously, exercise assembly 20 can be used by men, women and children of various strengths and abilities without changing, adding or removing parts and components.

Structurally, exercise assembly 20 has a water-engageable shaft, rod or bar 22 that is formed of a substantially water-impermeable and impact resistant material, such as lightweight aluminum or impact resistant plastic. Shaft 22 has a left hand blade-receiving portion 24 (FIG. 2) at one end, and a right hand blade-receiving portion 26 at the other end. A manually grippable handle portion 28 is positioned intermediate and between and connects blade-receiving portions 24 and 26. In the embodiment shown, shaft 22 has a square cross-section to facilitate gripping and is tubular to minimize weight and reduce construction costs.

In the illustrative embodiment, shaft 22 is generally rigid with the handle portion 28 spanning a length somewhat greater than the span of two hands so that it can be gripped by either one or two hands. While the illustrated embodiment is preferred, in some circumstances, it may be desirable that the shaft be solid or of a different shape, such as a cylindrical shape with knurled or other finger gripping portions, or that the shaft be more flexible or that the hand portion be somewhat large or smaller.

Shaft 22 is elongated and is generally straight or linear so as to extend along axis 30 (FIG. 2). The shaft has a width taken in a radial direction that is generally transverse to the axis 30.

Shaft 22 also serves to rigidify and connect a pair of diametrically opposed hydrodynamic resistance assemblies 32 and 33 that are coaxially connected and secured to blade-receiving portions 24 and 26, respectively, of the shaft. Each hydrodynamic resistance assembly 32 and 33 has a plurality of angularly disposed water-engageable radial blades or fins 34. Blades 34 extend radially from bar 22 and serve to deflect water and create a pressure head and fluid resistance to water flow as shaft 22 is moved in or through the water. Preferably, there are at least two pairs of diametrically opposed blades 34 at each end of the shaft. In the preferred embodiment, each of the two sets of diametrically opposed blades 34 are positioned generally perpendicular or at right angles to each other and each of the adjacent blades 34 cooperate with each other to define an angular aquatic pocket 35 for cuppingly engaging water as the shaft 22 is moved in the water.

Each of the radial blades 34 has a pair of opposed generally flat water impingement surfaces 36 and 38 which have a generally rectangular cross-sectional area. In use, one of the water impingement surfaces 36 or 38 is positioned generally normal or perpendicular to the direction of movement of the shaft 22 to hydrodynamically engage the water as the shaft is moved in the water. Water impingement surfaces 36 and 38 span a radial width or height that is substantially greater than the width of shaft 22, taken in a direction transverse to axis 30, to increase or intensify the water resistance of the water impingement surfaces. The water resistance (fluid resistive forces) exerted by the blades 34 as the shaft 22 is moved in the water can be increased by increasing the radial span or height of the blades 34 and thereby enlarging the effective cross-sectional area that is positioned generally normal to the direction of movement of the shaft 22.

The blades 34 of each of the hydrodynamic resistance assemblies 32 and 33, respectively, are spaced an effective distance from the handle portion 28 of the shaft 22 to exert a hydrodynamic torque on the handle portion 28 as the shaft is moved in or through the water so as to strengthen the muscles of the user. If the user's hand is held in the middle of the shaft and the shaft is not rotated or pivoted, the torque exerted by the blades extending from the left hand side of the shaft will counterbalance and offset the torque exerted by the blades extending from the right hand side of the shaft 22.

A transverse blade or fin 40 is secured to each end of the shaft 22 at a position generally normal to and abuttingly engaging the radial blades 34. Transverse blades 40 create an axial pressure head and fluid resistance to the water when the shaft is moved axially in or through the water. In the illustrative embodiment, the transverse blade is positioned axially outward of the radial blades 32, and is generally rectangular and generally planar or flat. In some circumstances, it may be desirable to position the transverse blades axially inwardly of the radial blades.

While the illustrated embodiment is preferred, it may be desirable in some circumstances, however, that there are more or less blades at each end of the shaft or at different angles, or that the blades be curved or twisted or of a different shape or formed of a different material.

In use, the aquatic exercise assembly 20 is moved or swung in the water at a selected acceleration and momentum to create the desired resistance, torque and torsion upon the arms of the person using the exercise assembly.

Figure 4:
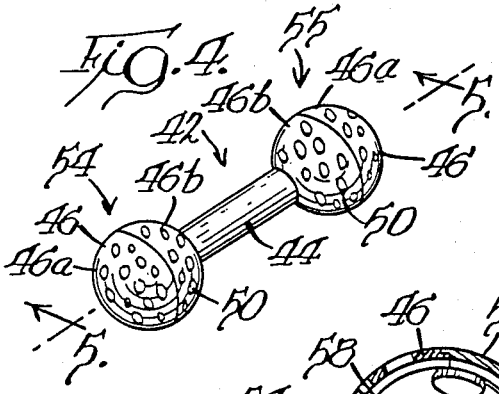
FIG. 4 is a perspective view of a barbell-like ball type of aquatic exercise assembly.
Figure 5:
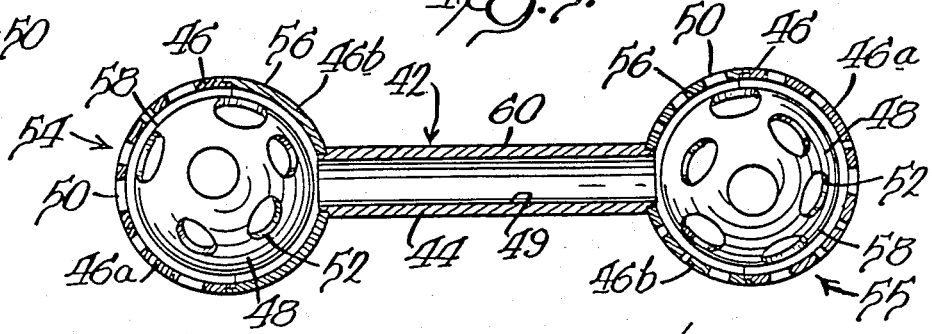
FIG. 5 is an enlarged cross-sectional view of the aquatic exercise assembly of FIG. 4.

Referring now to FIGS. 4 and 5, a barbell-like ball type of aquatic exercise assembly 42 is shown for use in water. Ball type exercise assembly 42 is similar to the blade type exercise assembly 20 (FIGS. 1–3) except that each of the ends of the water-engageable shaft or rod 44 securely carries a generally spherical water-engageable outer hollow shell 46 that houses an internal hollow ball 48 and shaft 44 defines a fluid-flow passageway 49 in fluid communication with the outer shells 46 and internal balls 48. Each outer shell 46 is coaxially and fixedly connected to the end of bar 24 and defines a plurality of fluid-flow apertures or holes 50 therein. Outer shell 46 is preferably made of two semi-spherical complementary cup-like parts 46*a* and 46*b* (FIG. 4) which are detachably connected to each other, such as by complementary threads, snaps or tabs.

Internal ball 48 is hydro-rotatably positioned within its associated shell 50 and defines a plurality of fluid-flow openings or holes 52 that are positioned in fluid communication with shell apertures 50 to accommodate passage of water through the internal ball 48 and outer shell 46 as the exercise assembly 42 is moved in the water. Each internal ball 48 and its associated outer shell 46 cooperate with each other to provide a hydrodynamic resistance assembly 54 or 55 that deflects water flow as shaft 44 and exercise assembly 42 are moved in the water.

Outer shell 46 and internal ball 48 are each preferably formed of a substantially water impermeable impact-resistant material, such as aluminum or impact-resistant plastic, as is shaft 44. Outer shell 46 and internal ball 48 each provide a water impingement surface 56 and 58 (FIG. 5), respectively, with a circular cross-sectional area for positioning generally normal or perpendicular to the direction of movement of shaft 44 in the water. Water impingement surfaces 56 and 58 hydrodynamically engage the water as the exercise assembly 42 is moved in or through the water.

The diameter of the outer shell's water impingement surface 56 is substantially greater than the width of shaft 44 to increase or intensify the water resistance of the outer shell 46. In the preferred form of ball type of exercise assembly 42, internal ball 48 is slightly smaller than outer shell 46 and has a circular cross-sectional area of a diameter substantially greater than the width of the shaft 44 to enhance the water resistance of hydrodynamic resistance assemblies 54 and 55.

The outer shell 46 and internal ball 48 of each hydrodynamic resistance assembly 54 and 55 are spaced an effective distance from the manually grippable handle portion 60 of the shaft 42 to exert a hydrodynamic torque on the handle portion 60 as the shaft is moved in or through the water. If the user's hands are held in the middle of the shaft and the shaft is not rotated or pivoted, the torque exerted by each hydrodynamic resistance assembly 54 and 55 will counterbalance and offset each other.

The ball type of aquatic exercise assembly 42 (FIGS. 4 and 5) provides many similar advantages as the blade type of aquatic exercise assembly 20 (FIGS. 1–3) and is used in a similar manner. As shaft 44 is moved or swung in the water, internal balls 48 rotate or spin within the interior of the shells 46.

Figure 6:
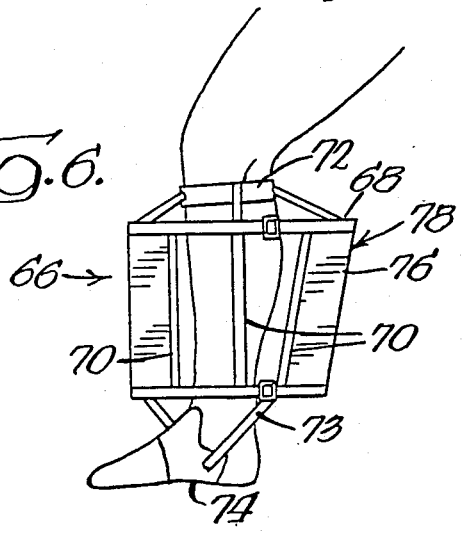
FIG. 6 is a perspective view of a blade-type aquatic leg exercise assembly that has been strapped onto the user's leg.

The blade or fin type of aquatic leg exercise assembly 66 shown in FIG. 6 is similar in many respects to the blade type of barbell exercise assembly 20 shown in FIGS. 1–3. Exercise assembly 66 has a flexible frame structure or assembly 68 connected to a plurality of elongated circumferentially spaced, generally upright shafts or bars 70. Frame 68 has an upper flexible strap 72 for connection to the user's leg and has lower flexible straps 73 connected to a stirrup 74 that fits upon the user's foot. Straps 72 and 73 and shafts 70 provide manually grippable handle portions which are readily graspable by the user. Each upright shaft 70 is axially connected to a generally upright water-engageable blade or fin 76. Each blade is preferably generally flat or planar with a rectangular shape. In some circumstances, however, it may be desirable that the blades be curved or of a different configuration. Collectively, the blades 76 provide a hydrodynamic resistance assembly 78 to deflect water and create a pressure head and fluid resistance to water flow as the exercise assembly 66 is moved in the water.

Figure 7:
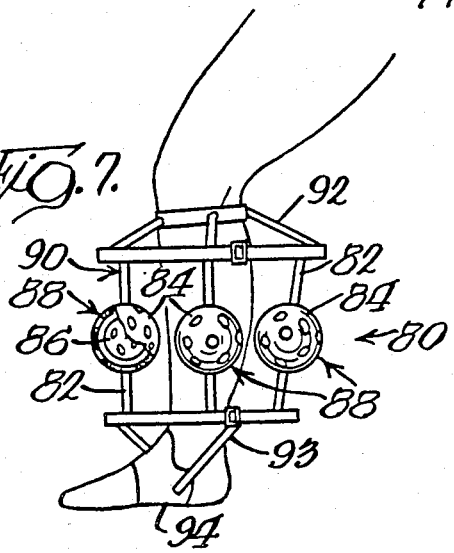
FIG. 7 is a perspective view of a ball-type aquatic leg exercise assembly with portions shown in cross-section.

The ball type of aquatic leg exercise assembly 80 shown in FIG. 7 is similar to the blade type of aquatic leg exercise assembly 66 shown in FIG. 6, except that each shaft or bar 82 securely carries at least one water-engageable hollow outer shell 84 that houses an internal hollow ball 86. Each outer shell 84 and internal ball 86 are structurally and functionally similar to the shells 46 and balls 48, respectively, of the barbell-like exercise assembly 42 of FIGS. 4 and 5, and provide a hydrodynamic resistance assembly 88. Frame 90, straps 92 and 93 and stirrup 94, respectively, are substantially identical to the frame 68, straps 72 and 73 and stirrup 74, respectively, of FIG. 6.

Figures 8, 9, 10, 11, 12, 13:
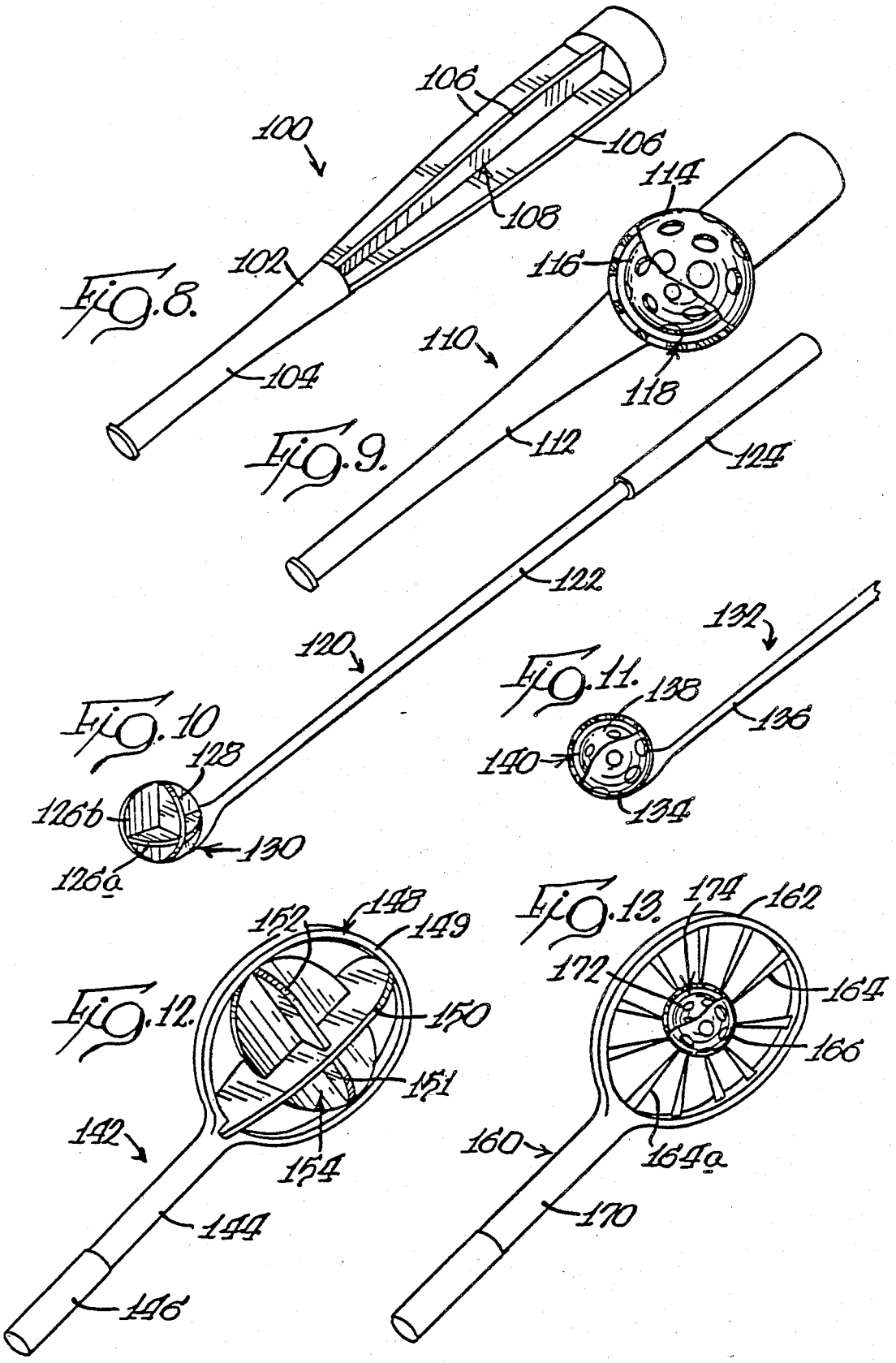
FIG. 8 is a perspective view of a bat-like blade-type of aquatic exercise assembly.
FIG. 9 is a perspective view of a bat-like ball-type of aquatic exercise assembly.
FIG. 10 is a perspective view of a golf club-like of aquatic exercise assembly.
FIG. 11 is a fragmentary perspective view of a golf club-like ball type of aquatic exercise assembly.
FIG. 12 is a perspective view of a racquet-like blade type of aquatic exercise assembly.
FIG. 13 is a perspective view of a racquet-like ball type of aquatic exercise assembly.

The bat-like blade type of aquatic exercise assembly 100 of FIG. 8 has a generally solid water-engageable shaft 102. Shaft 102 is in the form of a baseball bat or club with a manually grippable handle portion 104. Exercise assembly 100 has two sets of diametrically opposed generally flat blades or fins 106 that provide a hydrodynamic resistance assembly 108. Blades 106 are tapered inwardly towards handle 104 and are positioned at right angles to each other. Blades 106 operate in the water similarly to the radial blades 32 of the barbell-type aquatic exercise assembly 20 of FIGS. 1–3. If desired, curved blades, or blades having a different shape, or blades positioned at a different angular relationship can be used.

The bat-like ball-type of aquatic exercise assembly 110 shown in FIG. 9 is similar to the bat-like aquatic exercise assembly 100 shown in FIG. 8, except that the outer end of the bat-like water-engageable shaft 112 securely carries a water-engageable hollow outer shell 114 that houses an internal hollow ball 116. Outer shell 114 and internal ball 116 are structurally and functionally similar to shells 46 and ball 48, respectively, of the barbell-like exercise assembly 42 of FIGS. 4 and 5, and cooperate together to provide a hydrodynamic resistance assembly 118.

The golf club-like blade type of aquatic exercise assembly 120 shown in FIG. 10 has an elongated water-engageable shaft or shank 122 in the form of a golf club with a manually grippable handle portion 124 and blades or fins 126*a*, 126*b* and 128 that cooperate with each other to provide the head of the club. The blades include a semicircular axial blade 126*a* and a generally circular axial blade 126*b*, that are positioned at right angles to each other, as well as a transverse semi-circular blade 128. The transverse blade abuts against, intersects, and is positioned generally normal to axial blades 126*a* and 126*b*. Blades 126*a*, 126*b* and 128 cooperate with each other to provide a hydrodynamic resistance assembly 130 and function similarly to blades 32 and 40, respectively, of the barbell-like exercise assembly 20 shown in FIGS. 1–3.

The golf club-like ball type aquatic exercise assembly 132 of FIG. 11 is similar to the golf club-like aquatic exercise assembly 120 of FIG. 10, except that the head at the end of the shaft or shank 136, contains a water-engageable hollow outer shell 134 that houses an internal hollow ball 138, in lieu of blades. Outer shell 134 is securely connected to the end of shaft 136, while internal ball 138 is free to rotate and spin within the interior of shell 138 as the exercise assembly 132 is moved in the water. Outer shell 134 and internal ball 138 are structurally and functionally similar to the shells 46 and balls 48, respectively, of barbell-like exercise assembly 42 (FIGS. 4 and 5) and cooperate with each other to provide a hydrodynamic resistance assembly 140.

The racquet-like blade type of aquatic exercise assembly shown in FIG. 12 has a shaft or shank 144 in the form of a racquet with a manually grippable handle portion 146 and a racquet-like head 148. Racquet-like aquatic exercise assembly 142 can be in the form of a tennis racquet, racquetball racquet, lacrosse racquet, squash racquet, jai alai racquet, paddle, etc. Head 148 has an elliptical rim 149 that is connected to two water-engageable generally elliptical axial blades or fins 150 and 151, and a generally elliptical transverse fin 152. Axial blade 150 is secured to the upper end of shaft 144 and spans a greater length than the other blades 151 and 152. Blades 150, 151, and 152 function similarly to blades 32 and 49, respectively, of the barbell-like exercise assembly (FIGS. 1–3) and provide a hydrodynamic resistance assembly 154.

Referring now to FIG. 13, the racquet-like ball type aquatic exercise assembly 160 shown therein is similar to the racquet-like blade type aquatic exercise assembly 142 of FIG. 12, except that racquet head 162 has radial spokes 154 that are secured to a water-engageable hollow outer shell 166, in lieu of blades. Outer shell 166 is axially secured to shaft or shank 170, via axial spoke 164*a*, and houses an internal hollow ball 172. Outer shell 166 and internal ball 172 are structurally and functionally similar to the shells 46 and balls 48, respectively, of the barbell-like exercise assembly of FIGS. 4 and 5, and cooperate with each other to provide a hydrodynamic resistance assembly 174.

It can, therefore, be seen that each of the embodiments shown in FIGS. 1–13 has a generally impact-resistant water-engageable shaft formed of a substantially water impermeable material with a manually grippable handle portion for being grasped under water. Each of the above embodiments has at least one hydrodynamic resistance assembly that is coaxially and operatively connected to the shaft along its axis to deflect water and create a pressure head and fluid resistance to water flow as the shaft is move in and through the water. Each hydrodynamic resistance assembly has a water impingment surface with a cross-sectional area for positioning generally normal to the direction of movement of the shaft. The cross-sectional area of the water impingement surface spans a width, taken in a direction generally transverse to the shaft, that is substantially greater than the width of the shaft to increase the water resistance of the water impingement surface. Each hydrodynamic resistance assembly and its water impingement surface is spaced an effective distance away from the manually grippable handle portion of the shaft to exert a hydrodynamic torque on the handle portion as the shaft is being moved in or through the water.

While the ball type embodiments discussed above preferably have only one internal ball, it is to be understood that in some circumstances, it may be desirable to position more than one internal ball, either concentrically or adjacent each other within each outer shell, or omit the internal ball.

While the illustrated types of aquatic exercise assemblies are preferred, water-engageable surfaces of other shapes and configurations, such as a funnel-shaped surface or a semi-circular cup, can also be used to provide a hydrodynamic resistance assembly in accordance with the invention. Furthermore, the blades or fins, and the outer shell and internal balls of the present invention can be used with outher aquatic exercise assemblies, such as a helmet to strengthen the user's neck muscles, or a hoop and frame arrangement to strengthen the user's waist and torso muscles, or with a glove for karate-like exercises, etc.

Each of the above embodiments provide a wider range of movement in water with less stress on the joints of the user than is attainable with most types of conventional varbells and other exercise devices that are used on land, and offers many advantages to physical therapists.

Figure 14:
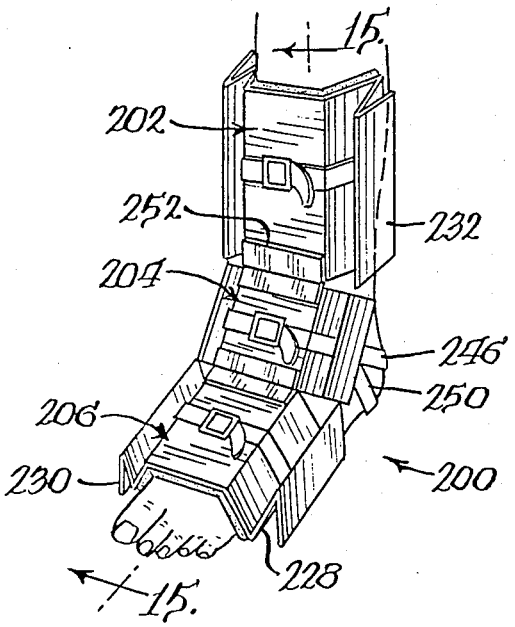
FIG. 14 is a perspective view of another blade type of aquatic leg exercise assembly that has been strapped onto the user's leg.
Figure 15:
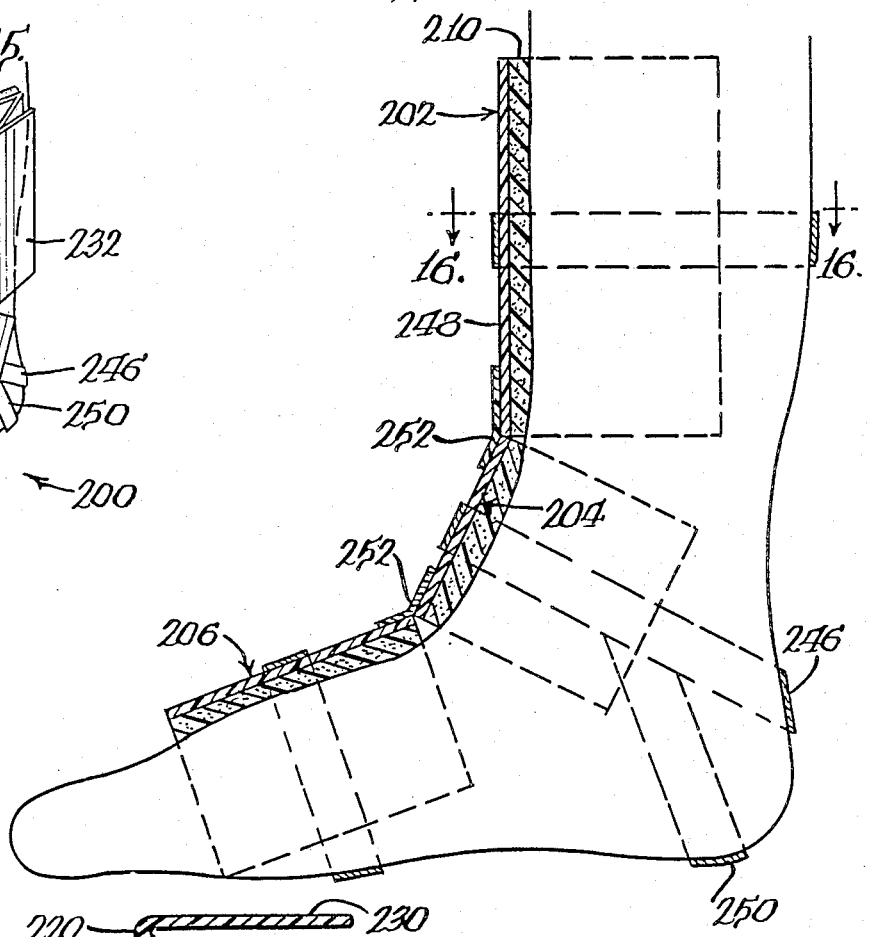
FIG. 15 is an enlarged cross-sectional view of the aquatic leg exercise assembly of FIG. 14 taken substantially along line 15—15 of FIG. 14.
Figure 16:
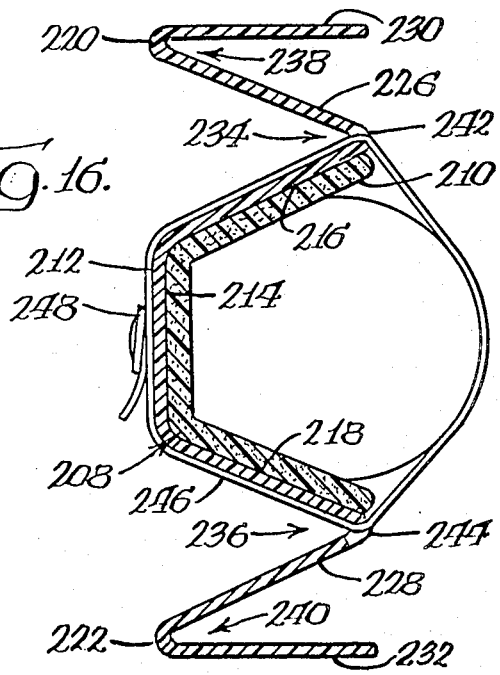
FIG. 16 is a cross-sectional view of the aquatic leg exercise assembly of FIG. 14 taken substantially along line 16—16 of FIG. 15.
Figure 17:
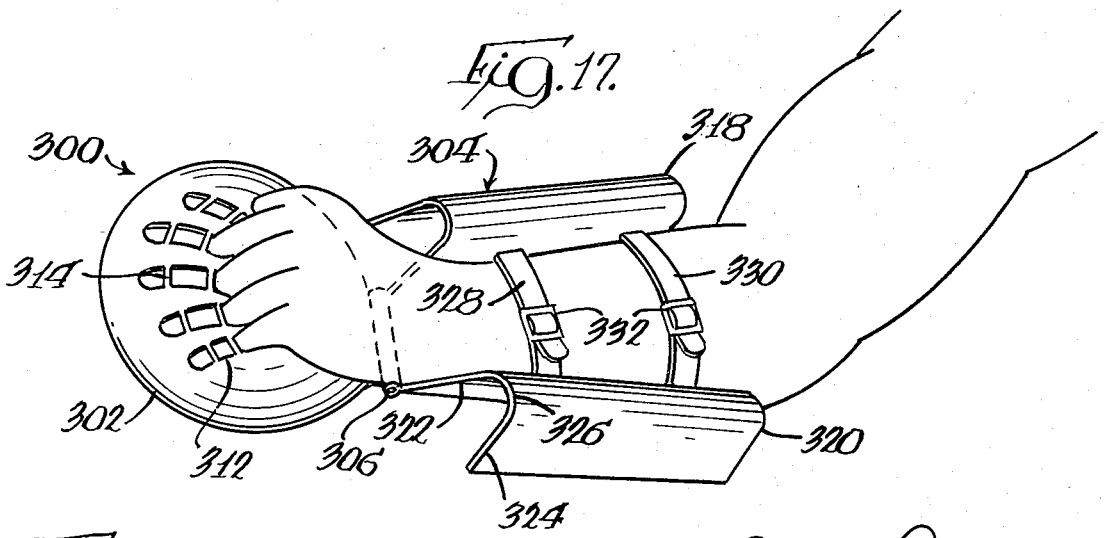
FIG. 17 is a hydrodynamic stroke builder strapped to a person's forearm in accordance with principles of the present invention.
Figure 18:
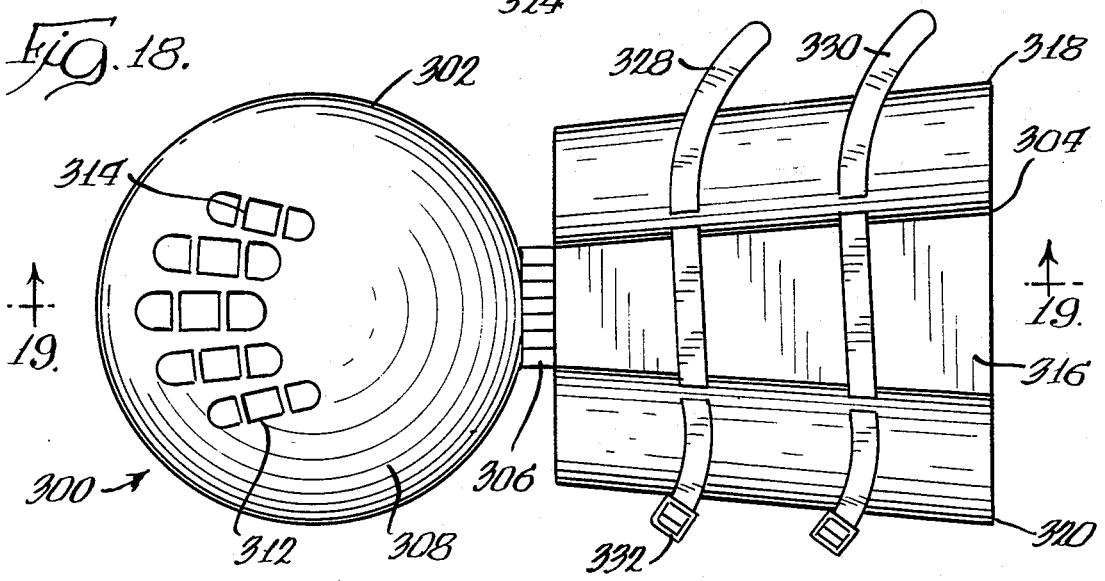
FIG. 18 is a top plan view of the hydrodynamic stroke builder.
Figure 19:
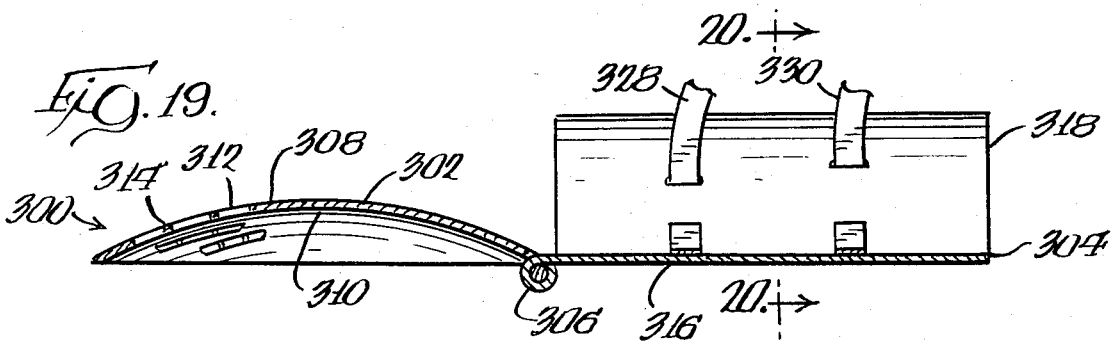
FIG. 19 is a sectional view of the hydrodynamic stroke builder taken substantially along line 19—19 of FIG. 18.
Figure 20:
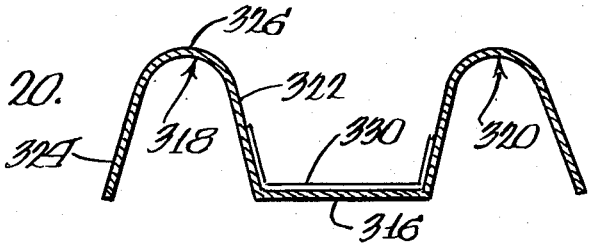
FIG. 20 is a cross-sectional view of the hydrodynamic stroke builder taken substantially along line 20—20 of FIG. 19.
Figure 21:
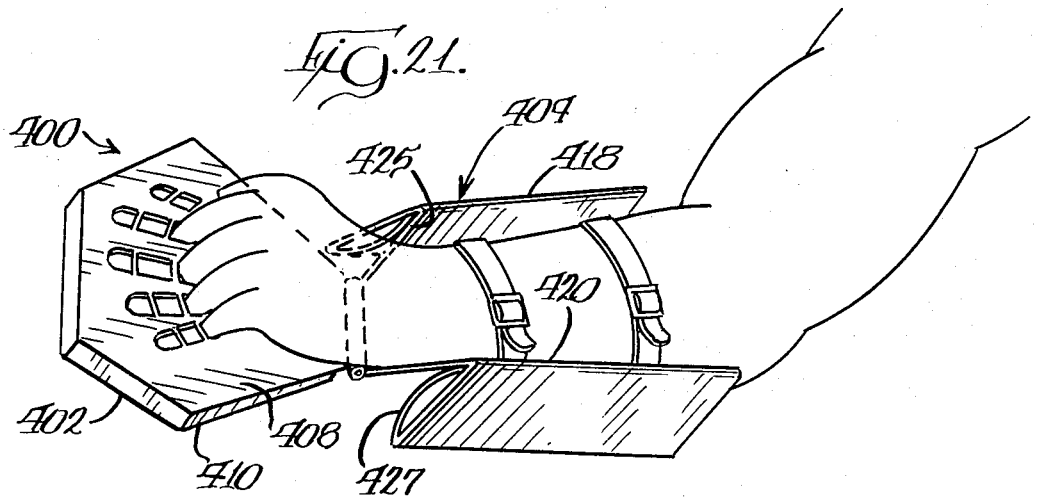
FIG. 21 is another hydrodynamic stroke builder strapped to a person's forearm in accordance with principles of the present invention.
Figure 22:
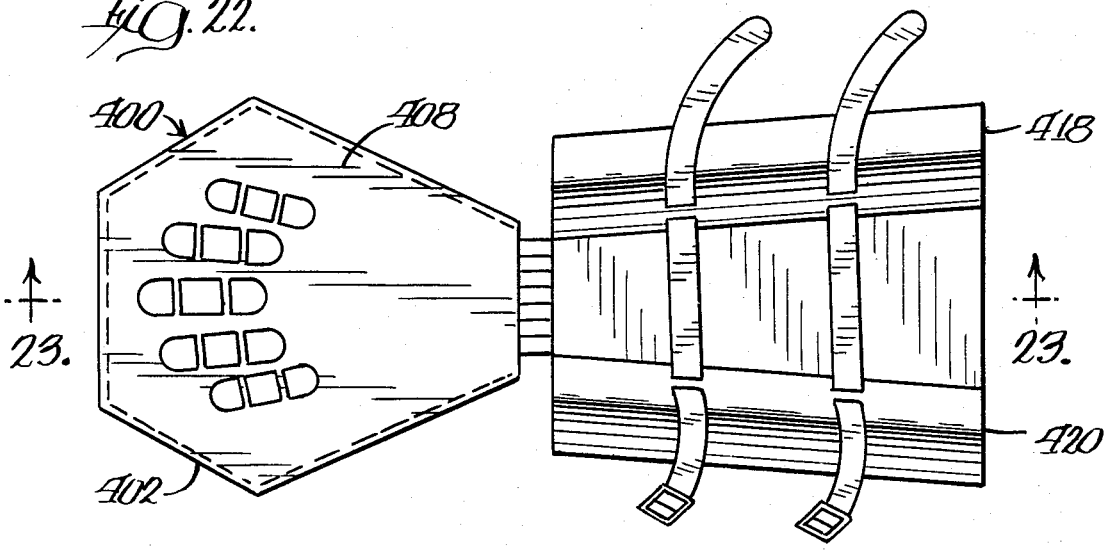
FIG. 22 is a top plan view of the hydrodynamic stroke builder of FIG. 21.
Figure 23:
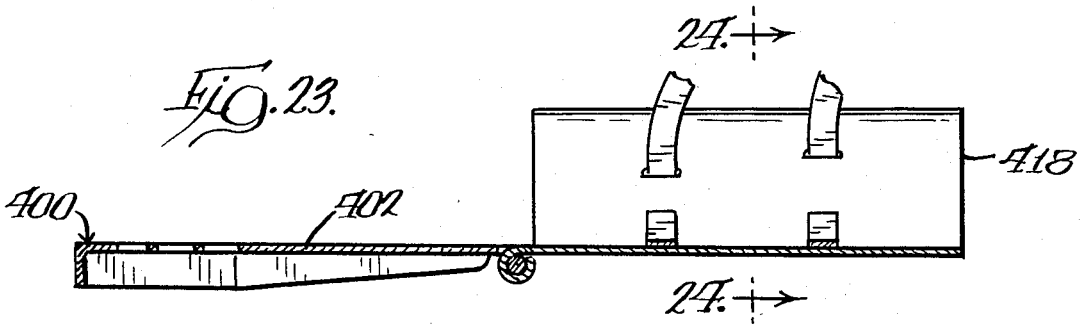
FIG. 23 is a sectional view of the hydrodynamic stroke builder taken substantially along line 23—23 of FIG. 22.
Figure 24:
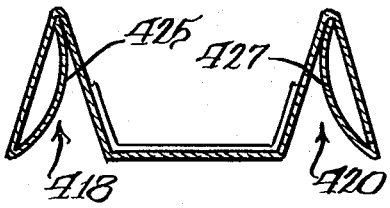
FIG. 24 is a cross-sectional view of the hydrodynamic stroke builder taken substantially along line 24—24 of FIG. 23.

The blade or fin type of aquatic leg exercise assembly 200 shown in FIGS. 14–16 provides an aquatic boot or hydrodynamic boot which is compact, easy to construct and effective to strengthen muscles, improve muscle tone and enhance muscular coordination. The aquatic boot is designed for use in water and is particularly valuable for therapy and recovery for leg injuries as well as to develop leg strength for various sports, such as football, soccer, baseball, running, jogging, basketball, tennis, volleyball, etc. Aquatic boot 200 is lightweight, comfortable and easy to use and permits the exerciser (user) or therapist to control the magnitude of the water forces, torque and torsion exerted on the user's leg, ankle and foot, via the aquatic boot, while minimizing harsh impact forces and shock. Control can be attained by varying the acceleration and momentum of the aquatic boot. The aquatic boot can be used by men, women and children of various strengths and ability without changing, adding or removing parts. The aquatic boot can come in various sizes and can also be used by patients and parapalegics alike to recover from disabilities and injuries.

Aquatic boot 200 has three sections or units 202, 204, and 206, including a lower leg section 202 which fits over and generally conforms to the front portion or shin of the lower leg between the kneecap and ankle, an ankle section 204 which fits over and generally conforms to the curved top portion of the ankle and a foot section 206 which fits upon and generally conforms to the top portion or roof of the foot. Each section is structurally similar, except that the leg section is somewhat longer than the foot section and the foot section is somewaht longer than the ankle section.

Each section 202, 204 and 206 has a generally U-shaped or channel-shaped composite leg-engaging portion 208 (FIG. 16) including an inner or internal generally U-shaped or channel-shaped, water-engageable deflector or baffle 212. Internal pad 210 is made of a rubber-like material that resiliently conforms to and matingly engages the front (shin), ankle or foot of the leg. Pad 210 can be water-impervious or can be made of other materials, such as plastic, styrofoam, etc. Deflector 212 is substantially rigid and made of impact resistant water-impervious plastic; light weight metal, such as aluminum, can also be used.

Deflector 212 (FIG. 16) has a generally planar or flat front face, plate or bight 214 and outwardly flared sides 216 and 218 which extend rearwardly and outwardly at an obtuse angle of 120 degrees from the ends of the front face 214. Sides 216 and 218 are generally planar and flat and provide inner fins or wings.

Generally V-shaped outer fins or wings 220 and 222 are integrally connected to the rearward ends of sides 216 and 218, respectively. Outer fins 220 and 222 each have an inner flared side 226 or 228 and an outer transverse fin or wing 230 or 232. Inner sides 226 and 228 extend forwardly and outwardly at an acute angle of 60 degrees from the rearward end of front-engaging sides 216 and 218, respectively, and provide inclined fins or wings. Sides 226 and 228 are generally planar or flat and cooperate with the front-engaging sides 216 and 218 to define forwardly-facing V-shaped pockets or cups 234 and 236 therewith which cuppingly and resistively engage the water as the aquatic boot 200 is move in a forward or upward direction in the water.

Transverse fins 230 and 232 (FIG. 16) are generally planar or flat and are generally perpendicular or normal to the front face 214. Transverse fins 230 and 232 provide end portions and transverse surfaces that resistively engage the water as the aquatic boot 200 is moved sideways through the water. Transverse fins 230 and 232 also extend rearwardly at an acute angle of 30 degrees from the front of adjacent sides 226 and 228, respectively, to define rearwardly facing V-shaped pockets or cups 238 and 240 which cuppingly and resistively engage the water as the aquatic boot is moved backwards through the water.

While the transverse fins 230 and 232 of the lower leg, ankle and foot sections 202, 204 and 206 preferably extend about one half the thickness of the lower leg, ankle and foot, respectively, and are perpendicular to the front face 214, they can extend a shorter or longer distance and/or extend at an angle of inclination relative to the front face. The transverse fins of the lower leg section can also extend rearwardly of the lower leg, if desired, or can progressively flare out in an upward direction to cover the entire calf for aesthetic appeal as well as for greater hydrodynamic resistance for stronger athletes. The transverse fins on the inside of the leg can be longer and wider than the transverse fins on the outside of the leg of the leg, ankle and foot sections for increased resistance on the inside of the leg. The transverse fins can also extend at an angle of more than 45 degrees from the front sides 226 and 228 of the leg, ankle and foot sections to open up the wedge for even greater hydrodynamic resistance.

Inner fins 216 and 218 and outer fins 220 and 222 cooperate with each other to provide generally N-shaped fins or wings which are compact and provide increased surface area to effectively resist movement through the water. The fins provide hydrodynamic resistance assemblies which hydrodynamically deflect water and create a pressure head and fluid resistance to water flow as the aquatic boot is moved through the water. The fins are positioned an effective distance from the front face 214 to exert a hydrodynamic torque on the front face and leg to strengthen the muscles of the leg, ankle and foot. The fins extend laterally outwardly in a sidewise direction from the front face 214 and are substantially rigid to provide an effective hydrodynamic force, torque and pressure head. The rearward extremities of the fins are aligned with each other.

While the front face 214 and fins 216, 218, 220 and 222 are preferably shaped and proportioned as shown in FIG. 16 and described above for enhanced effectiveness, the front face and fins can be curved or proportioned differently, such as at different angular relationships. One or more fins can also be parallel to the front face. Furthermore, some exercisers (users) may prefer to use the aquatic boot without an internal pad.

The front face 214 and fins 216, 218, 220 and 222 define water-resistant impingement surfaces and solid barriers which are substantially imperforate except for strap-receiving holes, openings or apertures 242 and 244 (FIG. 16) in the middle of rearward apexes of the forwardly facing V-shaped pockets 234 and 236. Holes 242 and 244 receive a flexible strap or belt 246 which tie around the calf (back) of the leg, heel and bottom of the foot, respectively. Strap 246 securely ties the sections 202, 204 and 206 of the aquatic boot to the leg, ankle and foot, respectively. Strap 246 has a buckle 248 in the front to detachably tighten, loosen or untie the strap. Holes 242 and 244 can be omitted if the strap is glued to the rearward portions of the outer fins 220 and 222 and the buckle is placed in the back. Ankle section 204 has an auxiliary strap 250 (FIGS. 14 and 15) which cooperates with main strap 246 to define a pocket which snugly fits over the heel of the foot.

Ankle section 204 is flexibly and pivotally connected to the leg section 202 and foot section 206 by nylon hinges 252 (FIGS. 14 and 15). Hinges 252 are attached to sections 202, 204 and 296 by bolts whose nuts rest against pad 210 or by marine adhesive, epoxy resin, or glue.

Some users may prefer to omit leg section 202 or foot section 206 or use one of the sections alone, either on the leg or foot. One or more of the sections can also be attached to the arm, such as for use by swimmers to strengthen their butterfly stroke, Australian crawl, etc., or for quarterbacks to strengthen their arms.

In the embodiment of FIGS. 17–20, there is shown a hydrodynamic stroke builder 300, which is also referred to as an aquatic exercise assembly or aquatic glove. The hydrodynamic stroke builder has a manually grippable hand section 302 and an elongated forearm section 304, which is similar in man respects to the lower leg section 202 of the aquatic boot 200. The hand section and forearm section each define an aquatic deflector which cooperate with each other to define a hydrodynamic resistance assembly. Hand section 302 is flexibly and pivotally connected to the forearm section by flexible nylon hinges 306. The hinges can be attached to the hand and forearm sections by bolts, marine adhesive, epoxy resin, glue, or other fastening means. The hinges can also be made of water resistant canvas, cloth, silicone rubber or metal, as can the hinges of the aquatic boot.

The hand and forearm sections 302 and 304 are made of a water-impervious, impact-resistant material, such as polypropylene. Other types of plastic, or plastics reinforced with glass or graphite, or non-corrosive light weight metal, such as aluminum, can be used. The hand and forearm sections are preferably rigid, although if desired, they can be partly flexible.

The hand section 302 is round and preferably oval or elliptical with a convex top or backhand surface 308 that comfortably engages and fits against the palm of the user's hand, and a concave bottom or back hand water-impingement surface 310 (FIG. 19) which provides an elliptical bowl-shaped pocket that cuppingly engages the water as the hand section is moved downwardly or rearwardly in the water towards the user's foot. The convex top (backhand surface) provides substantially less drag, hydrodynamic water resistive forces and pressure head on the user when the hand section is moved upwardly or forwardly in the water away from the user's foot than that exerted by the concave bottom (forehand surface) when it moves downwardly or rearwardly in the water towards the user's foot.

The hand section 302 has at least one set of finger holes 312 for snugly receiving the fingers of the user. In the illustrative embodiment, there are five finger holes, one for each finger. In some circumstances, it may be desirable to use less finger holes, such as the three finger hole arrangement used with a bowling ball. In the preferred embodiment, the finger holes extend entirely through the hand section and are formed by elliptical slots divided by spacer bars or finger sections 314 that are arranged to provide three different size finger holes in each slot so that the hand section can comfortably and interchangeably fit large and small hands of men, women and children alike. In some circumstances it may be desirable that each slot define more or less finger holes and/or that the finger holes do not extend through the concave bottom. The hand section can also be circular, if desired, and/or have a wrist strap to fasten the hand section to the wrist or the back of the hand.

The forearm section 304 has a front face 316 with a generally planar or flat forearm-engaging surface or portion which generally conforms to and comfortably fits upon the portion of the forearm contiguous with the palm. The forearm-engaging surface can also be slightly concave or arcuate to conform to and fit upon the portion of the forearm contiguous with the palm. Extending laterally from each side of the front face is a generally U-shaped imperforate fin or wing 318 and 320. Each fin has an inner side 322 and an outer side 324 connected by a rounded bight 326. The inner sides extends at an obtuse angle of 100 degrees to 150 degrees, and preferably 120 degrees, rearwardly of the front face. The outer side preferably extends at an acute angle of 30 degrees to 60 degrees forwardly of the bight until its front edge is in coplanar alignment with the front face. The inner and outer sides are preferably arcuately complementary to each other. If desired, the outer side can be perpendicular to the front face or longer or shorter than the inner side or in offset relationship to the front face.

The inner and outer sides 322 and 324 of each fin 318 and 320 cooperate with each other to define a downwardly or rearwardly facing elongated concave, aquatic pocket extending from 30 to 60 degrees, which cuppingly engages the water and exerts substantially more drag, hydrodynamic water resistive forces and pressure head when the forearm is moved downwardly or rearwardly in a direction generally towards the user's foot, than the curved convex top surface of the bight when the forearm section is moved upwardly or forwardly in the water in a direction generally away from the user's foot. The bottom of the front face can be flat, or convex, if desired, for increased drag, fluid resistive forces and pressure head when the forearm section is moved downwardly or rearwardly. The front face and fins of the forearm section also provide water impingement surfaces which resistively engage the water as the user moves his or her arm downwardly or rearwardly through the water.

The forearm section 304 has at least one, and preferably two flexible straps 328 and 330 which secure the forearm section to the user's forearm. In the illustrative embodiment, the straps are looped through slots or holes in the inner side 322 of the fins so that the straps snugly contact the front and back of the user's forearm. Each strap has a buckle 322 to detachably tighten, loosen or untie the strap about the user's forearm. The holes can be omitted if the strap is glued or bonded to the fins. The straps are made of flexible plastic or a fabric impregnated with a water-proofing material, as are the straps in the aquatic boot.

Figure 25:
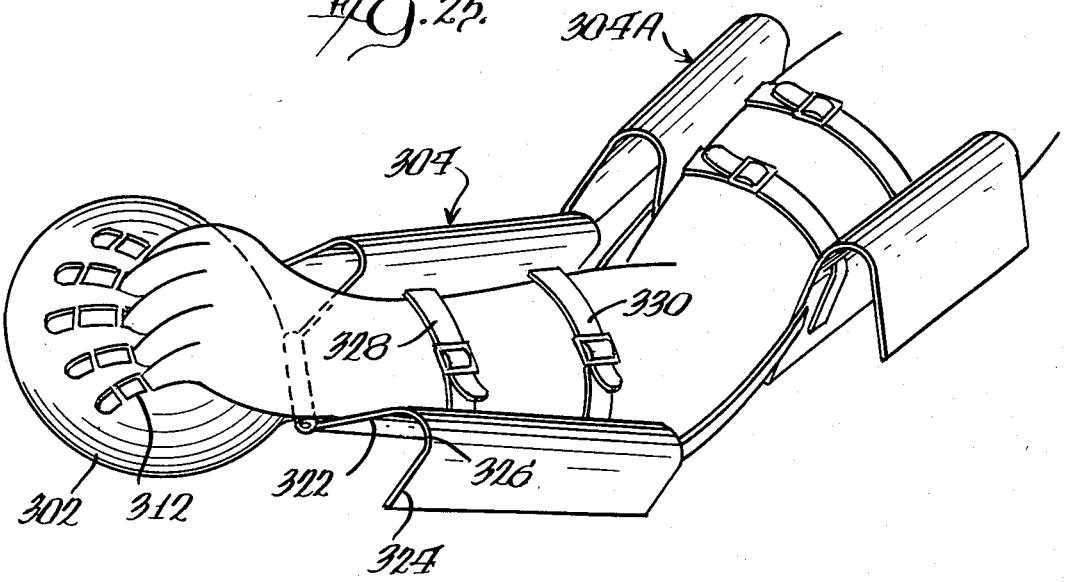
FIG. 25 is a hydrodynamic stroke builder strapped to a person's forearm and upper arm in accordance with principles of the present invention.

The forearm section 304 can also have a resilient internal liner, cushion or pad similar to the cushion of the aquatic boot. In some circumstances, it may also be desirable to have an upper arm section 304A (FIG. 25) that is similar and hingably connected to the forearm section. The upper arm section fits against the triceps of the user.

In use, the hydrodynamic stroke builder 300 is moved forwardly and rearwardly, or upwardly and downwardly, in the water to hydrodynamically engage and deflect the water and exert water resistive forces (water resistance) and torque on the user's wrist, forearm, elbow, biceps, triceps, shoulders, back, chest, and stomach. Preferably, there is one hydrodynamic stroke builder on each arm and the stroke builder is moved through the water in a swimming stroke manner. The hydrodynamic stroke builder is especially useful for swimmers because of the relatively high fluid resistive forces exerted by the stroke builder when the stroke builder is pulled downwardly in the water and relatively low fluid resistive forces exerted by the stroke builder when the stroke builder is pushed upwardly in the water.

Desirably, the hydrodynamic stroke builder 300 is compact, easy to construct and effective to progressively strengthen muscles, improve muscle tone and enhance muscular coordination. The stroke builder is particularly useful for therapy and recovery of arm injuries as well as to develop the strength of the user's wrists, forearms, triceps, biceps, shoulders, chest, and back. The stroke builder can be used by swimmers to strengthen their butterfly stroke, Australian crawl, side stroke, etc., as well as for quarterbacks, boxers, karate ethusiasts, pitchers, basketball players, tennis players, and other athletes to strengthen their arms.

The hydrodynamic stroke builder 300 is lightweight, comfortable and easy to use and permits the user (exerciser) or therapist to control the magnitude of the water forces, torque and torsion exerted on the user's arms, shoulders, chest and back, while minimizing harsh impact forces and shock on the user. The water resistive forces, torque and torsion exerted on the user can be controlled by varying the acceleration or momentum of the stroke builder. The stroke builder can be used by men, women and children of various strengths and abilities without adding or removing weights or other parts.

Figure 26:
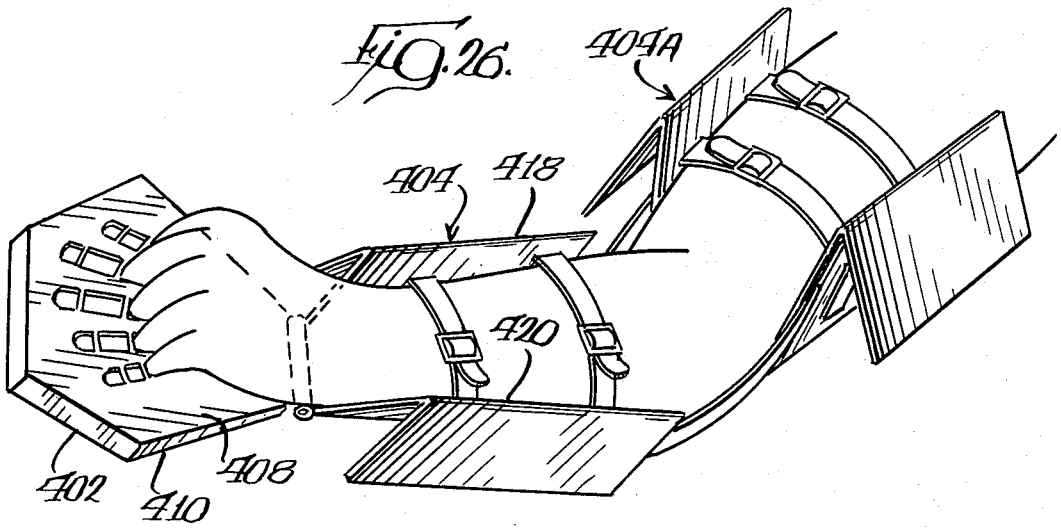
FIG. 26 is another hydrodynamic stroke builder strapped to a person's forearm and upper arm in accordance with principles of the present invention.

The hydrodynamic stroke builder or aquatic glove 400 of FIGS. 21–24, is similar to the hydrodynamic stroke builder 300 of FIGS. 17–20, except that the manually grippable hand section 402 has a generally planar or flat top or backhand surface 410 and the elongated forearm section 404 has generally V-shaped fins or wings 418 and 420. The hand section is also web shaped or hexagon shaped. The hydrodynamic stroke builder 400 offers many of the advantages of the stroke builder 300 of FIGS. 17–20. As in the embodiment of FIG. 25, in some circumstances, it may be also be desirable that the hydrodynamic stroke builder have an upper arm section 404A (FIG. 26) that is similar and hingably connected to the forearm section 404. The upper arm section fits against the triceps of the user.

It has been found that it is useful in some circumstances for the hand section of the aquatic glove discussed above, to be substantially imperforate, with the finger holes defined by rigid or flexible loops which are glued, laced or otherwise secured to and extending from the palm-engaging surface of backhand portion of the hand section. Different size loops can be bonded or laced to fit different size fingers. A single enlarged loop or strap can be used to fit the user's index and other fingers, excluding the thumb, in lieu of multiple finger loops.

The forearm section of the stroke builder can also have the same configuration as the leg section of the aquatic boot described above. The front face of the forearm section can also be V-shaped with an angle ranging from 10 degrees to 170 degrees and preferably from 30 degrees to 60 degrees. Furthermore, the hand section of the stroke builder can come in other shapes other than those illustrated and have a handle portion in lieu of finger holes.

If desired, the fins of the aquatic glove and boot can take the form of or include inflatable pockets such as 425 and 427 (FIG. 24) which expand and fill with water when the aquatic exercise assembly is moved through the water in the direction of the open end or mouth of the pocket and contract and at least partially empty when moved through the water in the opposite direction.

The fins of the aquatic glove and boot can further take the form of flexible imperforate webs or underwater aquatic sails which resistively billow when moved through the water. Preferably, the webs or sails are flexibly connected and conform to the leg or arm of the user.

Although embodiments of this invention have been shown and described, it is to be understood that various modifications and substitutions can be made by those skilled in the art without departing from the novel spirit and scope of this invention.

What is claimed is:

1. A hydrodynamic stroke builder for use in water to strengthen the user's arm muscles, comprising:

a manually grippable hand section defining at least one set of finger holes, said manually grippable hand section having a palm-engaging means and a water impingement means for exerting substantially more hydrodynamic resistive forces on the user's arm when said hand section is moved through the water towards the user's foot than when said hand section is moved through the water away from the user's foot;

an elongated forearm section having a front face with a forearm-engaging portion, at least one strap for securing said forearm-engaging portion against the user's forearm, and a pair of substantially stationary rigid imperforate fins fixedly secured and extending laterally from said front face, each of said stationary rigid imperforate fins having an inner side extending rearwardly at an obtuse angle of inclination from said front face and an outer side extending forwardly at an acute angle of inclination from said inner side, said inner and outer sides cooperating with each other to define a pocket for cuppingly engaging the water and exerting substantially more hydrodynamic resistive forces on the user's forearm when said forearm section is moved through the water towards the user's foot than away from the user's foot; and hinge means pivotally connecting said hand section to said forearm section.

2. A hydrodynamic stroke builder in accordance with claim 1 wherein said palm-engaging means is generally convex and said water impingement means is generally concave.

3. A hydrodynamic stroke builder in accordance with claim 8 wherein said hand section is elliptical.

4. A hydrodynamic stroke builder in accordance with claim 8 wherein said hand section is circular.

5. A hydrodynamic stroke builder in accordance with claim 1 wherein said hand section comprises a substantially rigid web-shaped hand section with a generally planar palm-engaging means and a generally planar water impingement means.

6. A hydrodynamic stroke builder in accordance with claim 7 wherein said hand section defines a plurality of sets of different size finger holes.

7. A hydrodynamic stroke builder in accordance with claim 1 wherein said finger holes are defined by a set of loops extending from and secured to said palm-engaging surface.

8. A hydrodynamic stroke builder in accordance with claim 1 including an upper arm section structurally similar to said forearm section for attachment to the triceps of the user and second hinge means for pivotally connecting said upper arm section to said forearm section.

9. A hydrodynamic stroke builder in accordance with claim 7 wherein said front face is generally planar.

10. A hydrodynamic stroke builder in accordance with claim 7 wherein said forearm-engaging portion is arcuate.

11. A hydrodynamic stroke builder in accordance with claim 1 wherein said fins are each generally U-shaped with a rounded bight and a generally convex pocket.

12. A hydrodynamic stroke builder in accordance with claim 1 wherein said fins are each generally V-shaped with a generally V-shaped pocket.

13. A hydrodynamic stroke builder in accordance with claim 1 wherein each of said outer sides of said stationary rigid imperforate fins has a front edge positioned in generally coplanar alignment with said front face, said outer sides extend at an angle of about 30 degrees to about 60 degrees from said inner sides of said stationary rigid imperforate fins, and said inner sides of said fins each extend at an angles of about 100 degree to about 150 degrees from said front face.

14. A hydrodynamic stroke builder for use in water to strengthen the user's arm muscles, comprising:

a hand section having manually grippable portion and a water impingement surface; and a substantially rigid forearm section operatively associated and cooperating with said hand section for engaging and deflecting water and exerting hydrodynamic resistive forces on the user when said hydrodynamic stroke builder is moved in the water, said substantially rigid forearm section having a generally imperforate forearm-engaging portion and at least one substantially stationary, generally rigid, U-shaped fin fixedly secured to said forearm-engaging portion.

15. A hydrodynamic stroke builder for use in water to strengthen the user's arm muscles, comprising:

a hand section having a manually grippable portion and a water impingement surface; and a substantially rigid forearm section operatively associated and cooperating with said hand section for engaging and deflecting water and exerting hydrodynamic resistive forces on the user when said hydrodynamic stroke builder is moved in the water, said substantially rigid forearm section having a generally imperforate forearm-engaging portion and at least one substantially stationary, generally rigid, V-shaped fin fixedly secured to said forearm-engaging portion.

* * * * *